US006318959B1

(12) United States Patent
Kambe

(10) Patent No.: US 6,318,959 B1
(45) Date of Patent: Nov. 20, 2001

(54) MULTI-STAGE ROTARY VACUUM PUMP USED FOR HIGH TEMPERATURE GAS

(75) Inventor: Shigeharu Kambe, Kawasaki (JP)

(73) Assignee: Unozawa-Gumi Iron Works, Ltd., Tokyo (JP)

( * ) Notice: Subject to any disclaimer, the term of this patent is extended or adjusted under 35 U.S.C. 154(b) by 0 days.

(21) Appl. No.: 09/392,464

(22) Filed: Sep. 9, 1999

(30) Foreign Application Priority Data

Dec. 22, 1998 (JP) ..... 10-364932
Dec. 22, 1998 (JP) ..... 10-364935

(51) Int. Cl.[7] ..... F01D 11/00
(52) U.S. Cl. ..... 415/112; 415/175; 415/230
(58) Field of Search ..... 415/112, 170.1, 415/175, 229, 230; 184/6.16

(56) References Cited

U.S. PATENT DOCUMENTS

| | | | | |
|---|---|---|---|---|
| 2,937,807 | | 5/1960 | Lorenz . | |
| 4,173,440 | * | 11/1979 | Libis | 418/84 |
| 4,394,113 | * | 7/1983 | Bammert | 418/98 |
| 5,364,245 | * | 11/1994 | Kriehn et al. | 418/9 |
| 5,727,936 | | 3/1998 | Eriksson et al. . | |
| 6,045,343 | * | 4/2000 | Liou | 418/91 |

FOREIGN PATENT DOCUMENTS

| | | |
|---|---|---|
| 194 825 A | 12/1937 | (CH) . |
| 10 21 530 B | 12/1957 | (DE) . |
| 0 476 631 A1 | 3/1992 | (EP) . |
| 0 814 267 A1 | 12/1997 | (EP) . |
| 3-89080 | 4/1991 | (JP) . |
| 5-71487 | 3/1993 | (JP) . |
| 6-101674 | 4/1994 | (JP) . |

* cited by examiner

*Primary Examiner*—Edward K. Look
*Assistant Examiner*—James M McAleenan
(74) *Attorney, Agent, or Firm*—Merchant & Gould P.C.

(57) ABSTRACT

In a multiple-stage rotary type vacuum pump, gas is compressed in one pump section and passes through a communication path into the next pump section for successive compression. The mechanical seals 51, 52 are arranged in the sides of the housing of the bearings 351, 352. An oil pump 42 for lubrication oil for the bearings is arranged for supplying lubrication oil to the bearings. The oil pump is communicated with the oil vessel 40. The discharge opening of the oil pump is communicated with oil supply pipes 311, 312 communicated with the supporting bodies 341, 342 of the mechanical seals. A return oil piping 43 is arranged for returning the lubrication oil.

3 Claims, 16 Drawing Sheets

MULTI-STAGE ROTARY VACUUM PUMP USED FOR HIGH TEMPERATURE GAS

BACKGROUND OF THE INVENTION

1. Field of the Invention

The present invention relates to a multi-stage rotary vacuum pump used for high-temperature gas, and is applicable to a vacuum pump handling gas at, for instance, about 150° C. to 250° C.

2. Description of the Related Arts

Where high temperature gas is sucked by a vacuum pump, a method for cooling the gas by cooling water applied outside a housing of the pump or rotors of the pump, a method for cooling the gas by a gas cooler located immediately before the inlet of the pump, or the like have been used. Since the heat of the high-temperature gas inside the housing is transferred through the shaft supporting the rotor to heat the bearings to a temperature higher than an allowable temperature, cooling from outside of a vacuum pump causes the following serious problems in using the vacuum pump. Since coolant water is to be supplied to a rotating rotor, the cooling of the gas by the coolant inside the rotating rotor must overcome structural problems. Since the gas may be solidified at a temperature lower than the solidification temperature, determined by the pressure and the temperature of the gas, in the cooling of the gas immediately before entering to the vacuum pump, it is required to design and construct a vacuum pump to overcome this problem of solidification.

A vacuum pump with first, second, and third pump sections as an example of a multi-stage vacuum pump cooled peripherally from outside is shown in FIG. 13. The XIV—XIV cross-section thereof is shown in FIG. 14, and the XV—XV cross-section thereof is shown in FIG. 15. The structure of the vacuum pump of FIG. 13 is as follows. The first pump section and the second pump section are separated by the wall 1, the second pump section and the third pump section are separated by the wall 2 as shown in FIG. 13. The first shaft 3 and the second shaft 4 penetrate each pump section, are supported by two bearing mechanisms 5, and are arranged to rotate in opposite directions by the timing gear set 6. The passage for the flow of the coolant water 7 is formed in the periphery of the housing. The first shaft, which penetrates to the outside, can be driven by an electric motor.

The suction gas G51 of the vacuum pump is sucked as a suction gas through the suction inlet 8 of the vacuum pump and the suction inlet 9 of the first section, and is transferred by the action of the rotors 10A and 10B. The exhaust gas G52 cooled by the coolant water in the periphery of the housing is led to the next stage through the communication path 11. These operations are repeated in each of the stages, and the gas is finally exhausted from the exhaust outlet 12 of the vacuum pump.

The cover 60 for the gear side is shown in FIG. 14. The input and output of the cooling water are indicated by symbol C in FIG. 15. the journal joint 13, the rotors 10A and 10B, the first axis 15, the second axis 16, the discharge openings 17 and 18 of the cooling water, and the flow C of the cooling water are shown in FIG. 16.

In this vacuum pump, the gas which is transferred and compressed by rotors in the housing is heated due to the heat of compression. A part of the heat is removed by the cooling by the coolant water 7 in the periphery of the housing. However, since the rotor is not cooled, the heat of the high temperature gas in the housing is transmitted through the shafts 3 and 4 which support the rotors to cause a problem in that the bearings are heated to a temperature higher than the allowable temperature.

In a method to solve this problem a gas cooling device is arranged immediately before the suction inlet to supply cooled gas through the suction inlet. The gas, however, is often solidified when the temperature of the gas becomes lower than the solidification temperature (which is determined by the pressure and temperature of the gas).

SUMMARY OF THE INVENTION

It is a primary object of the present invention, in view of the problems in the prior arts, to propose an improved rotary type multi-stage vacuum pump in which a high temperature gas is safely handled without cooling the gas.

According to the present invention, there is provided a multiple-stage rotary type vacuum pump, comprising: a housing with a plurality of pump sections having operable shafts and synchronously driven rotors supported by bearings mounted relative thereto, mechanical seals with supporting bodies arranged relative to the housing to be adjacent to said bearings, and an oil system providing oil to said mechanical seals and said bearings to lubricate and cool said bearings.

There is also provided a multiple-stage rotary type vacuum pump having a pump housing with a plurality of pump sections in which there are provided shafts supported by bearings, a rotor in each pump section fixed to each shaft with said shafts and rotors being arranged to be synchronously driven, and oil vessels for reserving lubrication oil, said pump housing having a suction inlet and an exhaust outlet and a communication path so that one pump section is in communication with the next pump section so that gas compressed in said one pump section passes through the communication path into the next pump section to cause the gas to be successively compressed in the plurality of pump sections, said vacuum pump comprising: mechanical seals with supporting bodies arranged relative to the pump housing to be adjacent to said bearings, an oil pump for providing lubricating oil to said supporting bodies for said mechanical seals and said bearings so that the lubricating oil is returned to said oil vessels, said vacuum pump having an oil supply piping system between said oil pump and the supporting bodies and a return oil piping system between said oil vessels and said oil pump, wherein said lubricating oil lubricates said bearings and also keeps them cool relative to said pump sections.

In general, the housing of the first stage of a vacuum pump is in the state of high vacuum, and that of the third stage is in the state of nearly atmospheric pressure. The oil vessel of the gear side and the oil vessel of the driving side have different pressures, and therefore, if these vessels are made in communication with each other, the lubrication oil in the oil vessel of the driving side cannot flow into the oil vessel of the gear side, since the oil tends to flow from the oil vessel of high pressure to that of low pressure.

In the vacuum pump according to the present invention, it is possible to arrange a mechanical seal in the housing side of the bearing, to seal the pressure, to cause both the oil vessels to communicate with the atmospheric pressure, to equalize the inner pressures, and to arrange a return oil piping to cause both oil vessels to communicate with each other. By equalizing the pressures of both oil vessels, it is possible to prevent the existence of a thrust load in the shaft, to facilitate the fixing of the shaft, and to extend the life of the bearing.

DETAILED DESCRIPTION OF THE PREFERRED EMBODIMENTS

Figure 1:
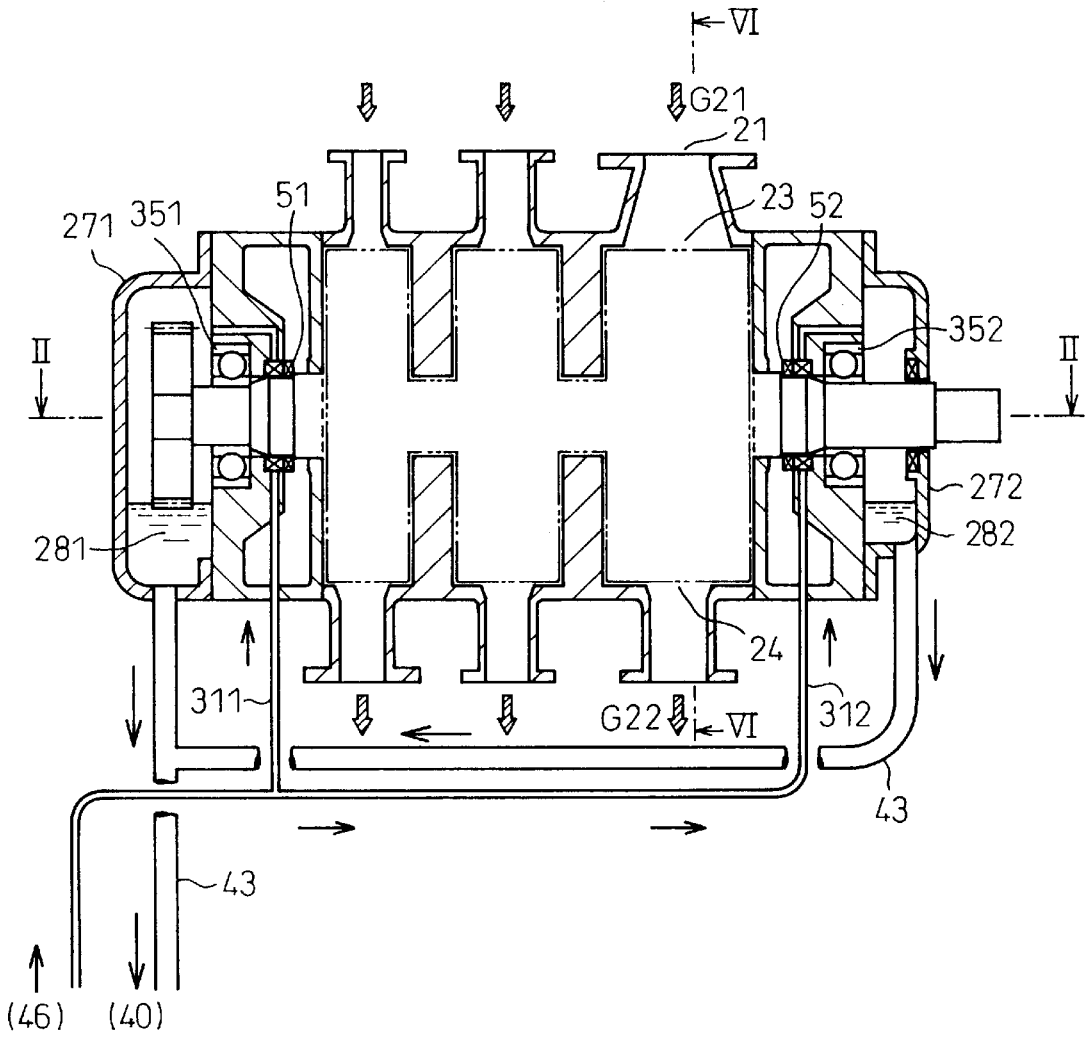
FIG. 1 shows a vacuum pump according to an embodiment of the present invention.
Figure 2:
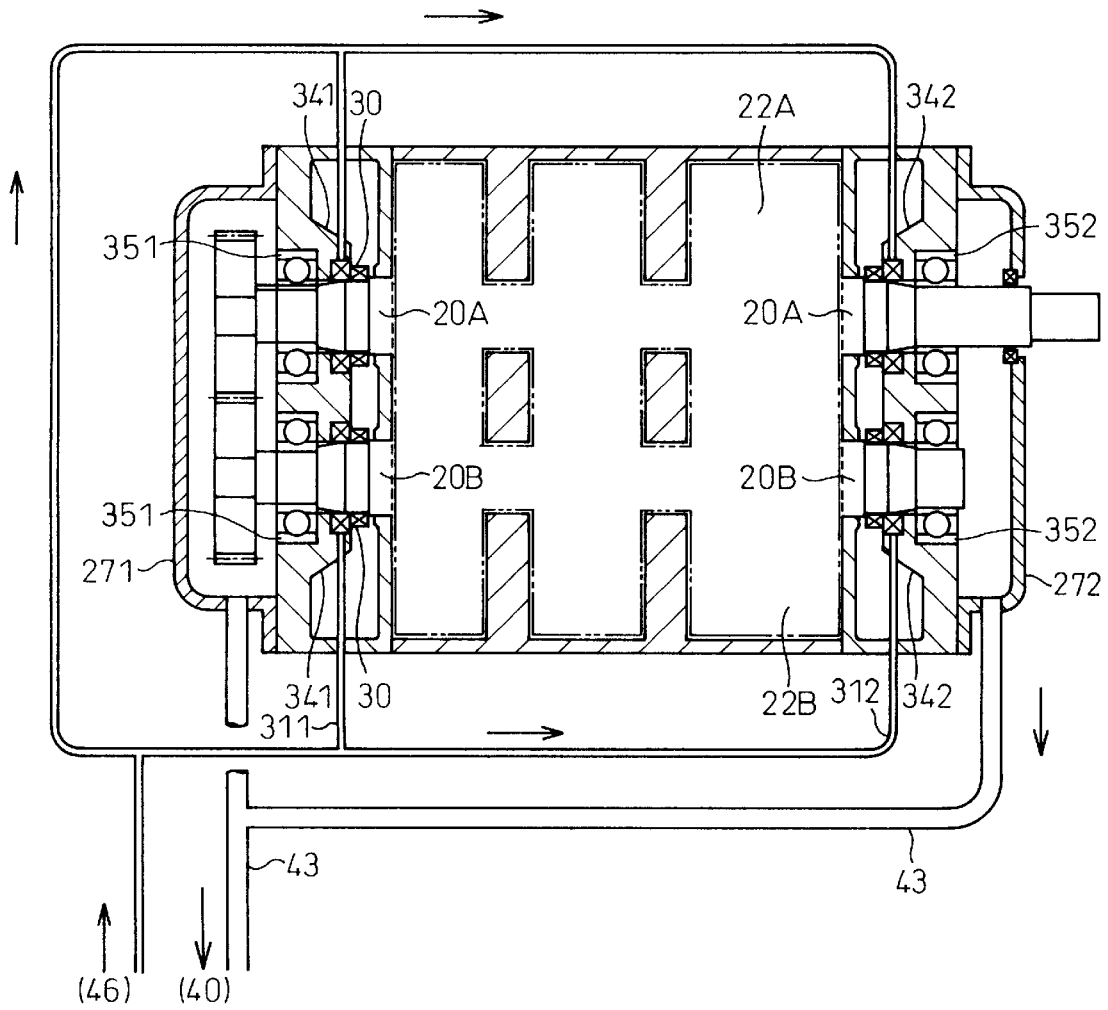
FIG. 2 is a cross-sectional view of the vacuum pump of FIG. 1 along line II—II.
Figure 3:
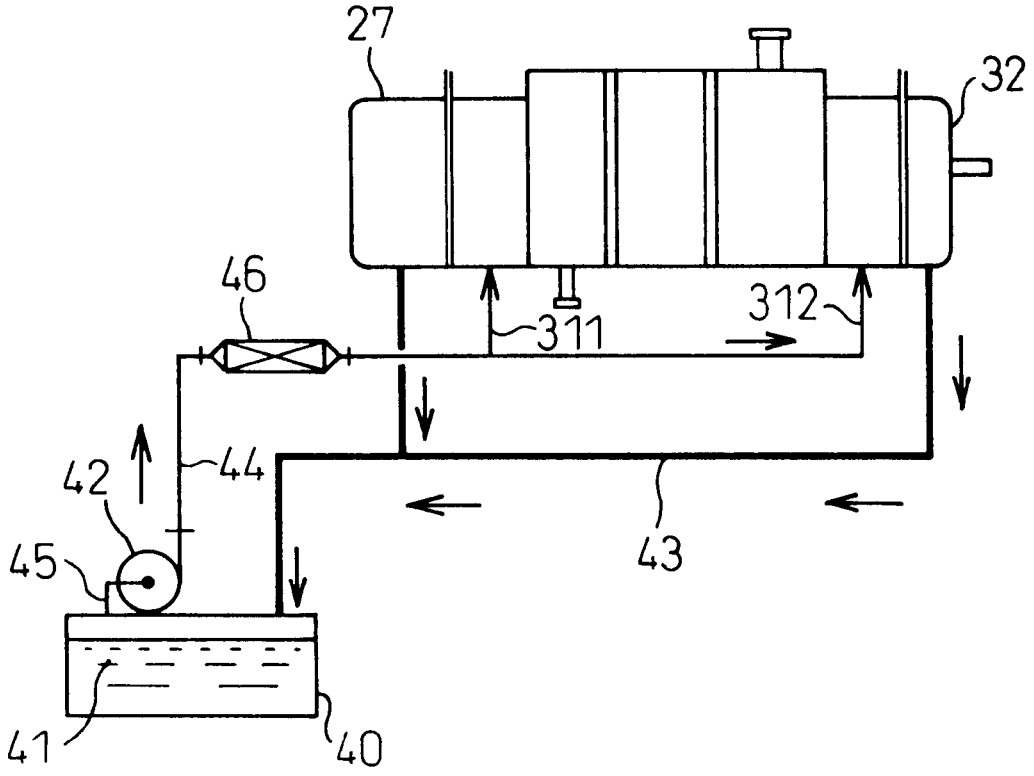
FIG. 3 shows an oil vessel, an oil pump, an oil cooling device, an oil supplying pipe, and a return oil piping in the vacuum pump of FIG. 1.
Figure 4:
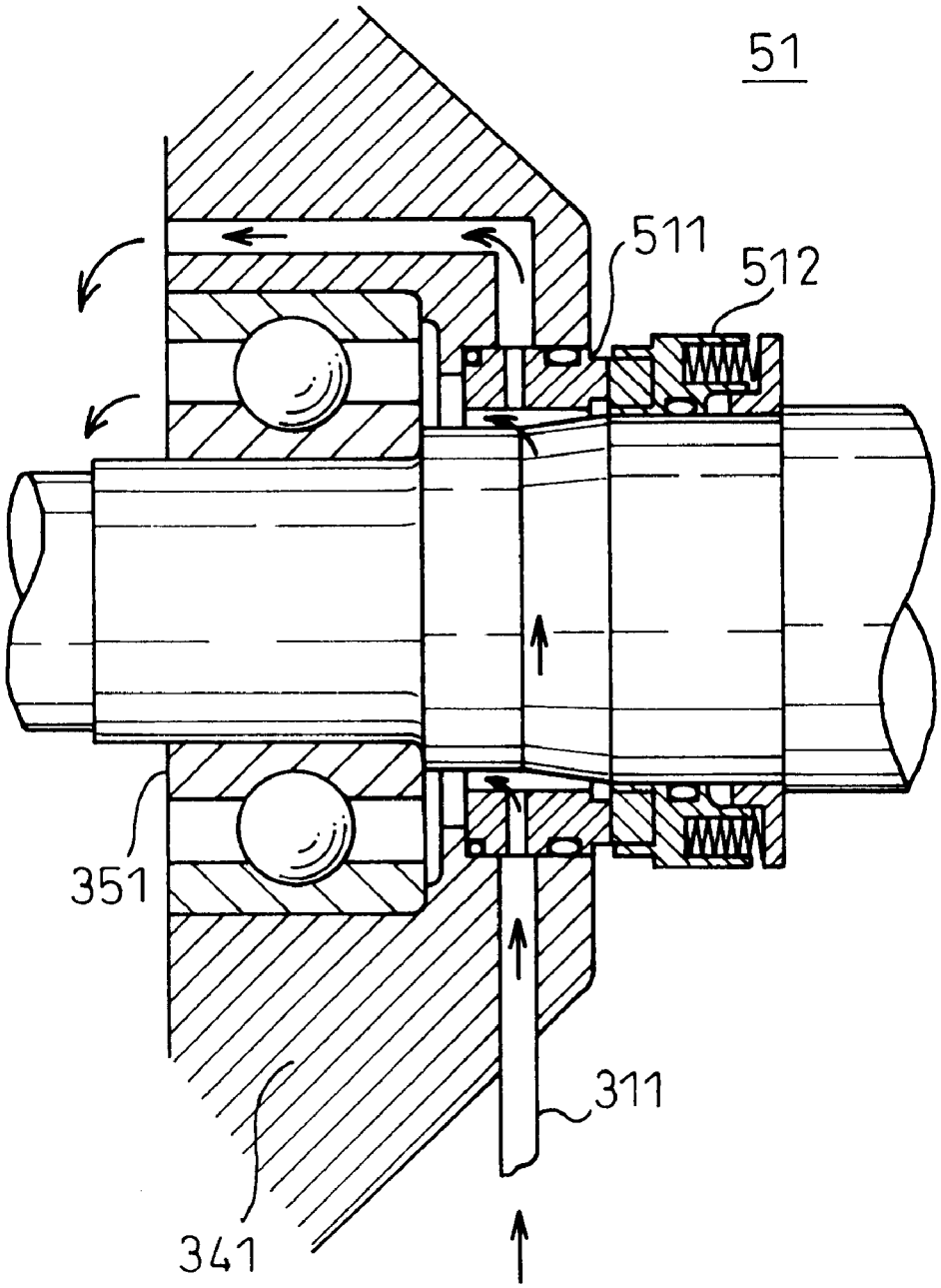
FIG. 4 shows a mechanical seal of left side in the vacuum pump of FIG. 1.
Figure 5:
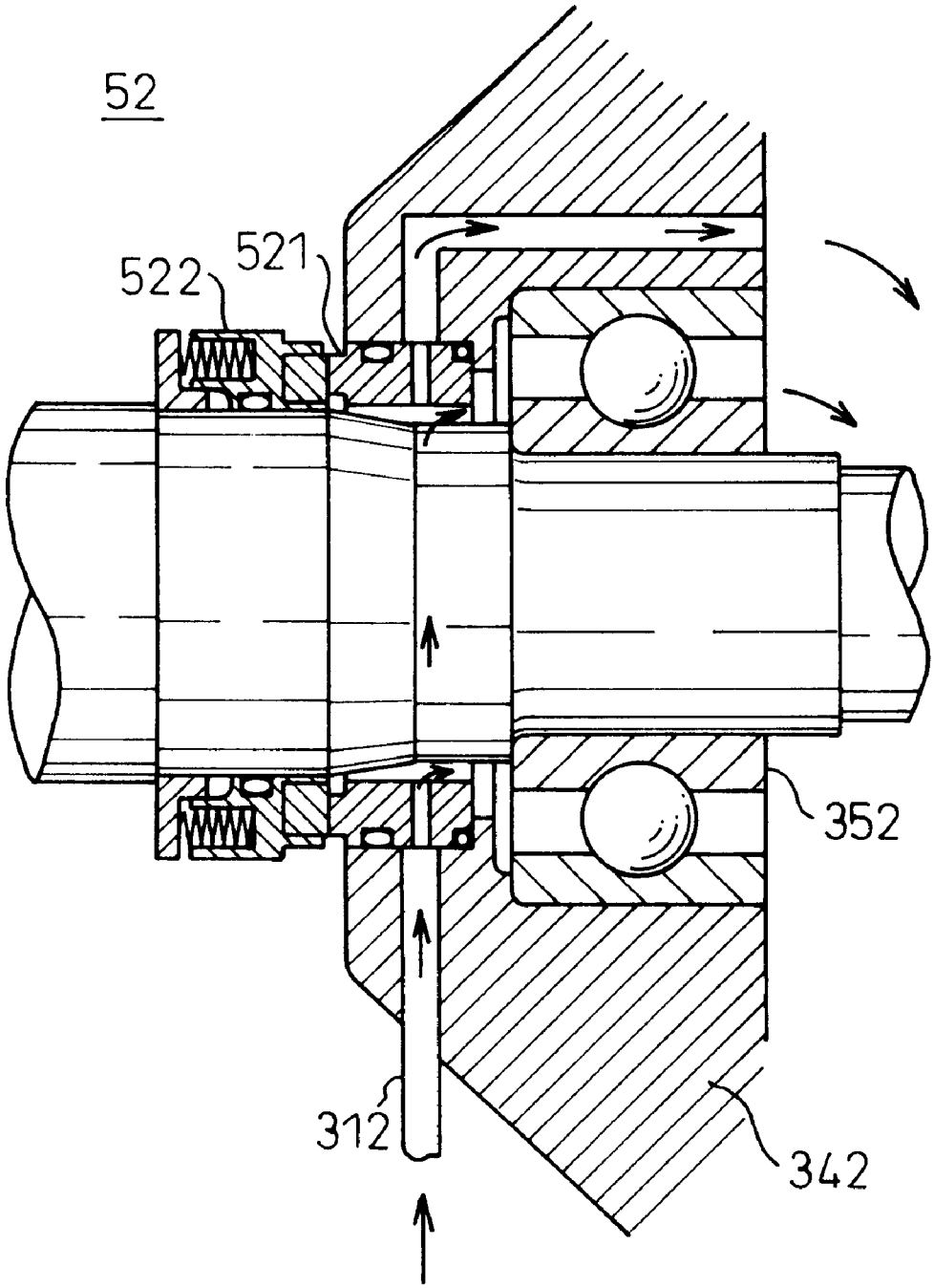
FIG. 5 shows a mechanical seal of right side in the vacuum pump of FIG. 1.
Figure 6:
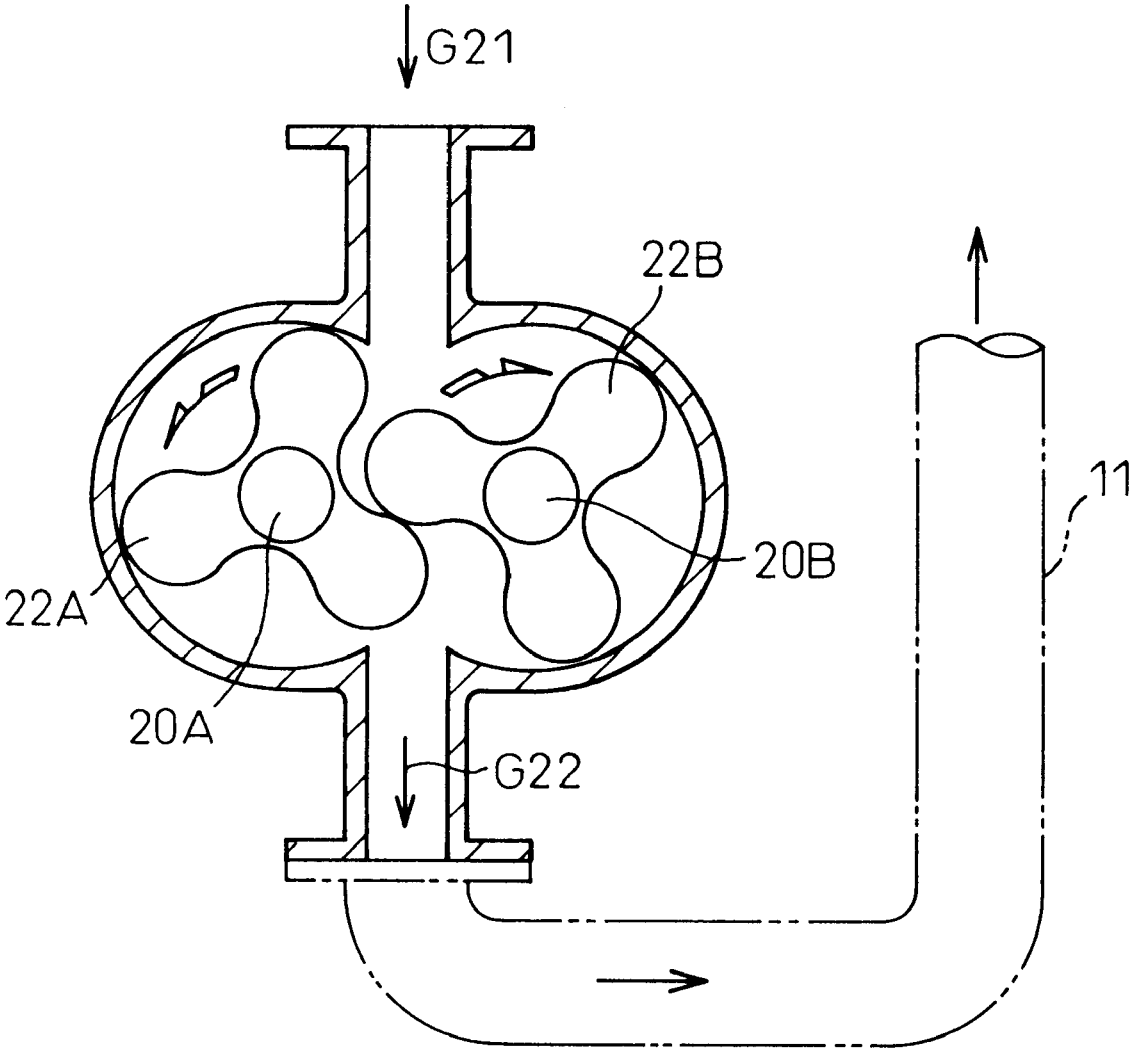
FIG. 6 is a cross-sectional view of the vacuum pump of FIG. 1 along line VI—VI.

A three stage rotary type vacuum pump according to an embodiment of the present invention will be explained with reference to FIGS. 1 to 6. The II—II cross-sectional view of the vacuum pump of FIG. 1 is shown in FIG. 2. The oil vessel, the oil pump, the oil cooling device, the oil supply pipe, and the return oil piping of the vacuum pump of FIG. 1 are shown in FIG. 3. The left side mechanical seal of the vacuum pump of FIG. 1 is shown in FIG. 4, and the right side mechanical seal is shown in FIG. 5. The VI—VI cross-sectional view of the vacuum pump of FIG. 1 is shown in FIG. 6.

The rotary type vacuum pump shown in FIGS. 1 to 3 is constituted by a plurality of pump sections and includes the shafts the pump sections supported by bearings, the rotors fixed to the shafts, the suction opening and the exhaust opening of the housing containing the pump sections, and a connection path connecting the exhaust opening of a pump section and the suction opening of the next pump section. The gas to be compressed is sucked into the next stage through the connection path so that the gas is successively compressed in the sequence of the stages of the vacuum pump.

In the first section of the vacuum pump, the suction gas G21 is sucked through the suction opening 21 of the vacuum pump and through the suction opening 23 of the first section, and transferred by the operations of the rotors 22A and 22B. The exhaust gas G22 is led to the next stage through the exhaust opening 24 and through the connection path. Such operations are carried out successively in a sequence of stages.

In this vacuum pump, there are mechanical seals 51 and 52 in the side of four bearings supporting the shaft, the oil vessel 40 outside the vacuum pump for reserving lubrication oil 41, and the oil pump 42 in the oil vessel for circulating the lubrication oil. The suction opening 45 is communicated with the oil vessel. At the exhaust opening of the oil pump, there are the oil supply pipes 311 and 312 communicated with the mechanical seal supporting bodies 341 and 342 of the gear side and the driving side. The oil supply pipes 311 and 312 are communicated with the oil cooler 46 (FIGS. 1–3). The mechanical seal 30 of the gear side is shown in FIG. 2. The oil vessel 27 of the gear side, the oil vessel of the driving side 32, the output passage 44 of the oil pump 42, and the oil cooler 46 are shown in FIG. 3. The connection passage 11 is shown in FIG. 6. Due to this structure, the lubrication oil is supplied to the mechanical seal supporting bodies, and a return oil piping for connecting the oil vessels of the gear side and the driving side to an external oil vessel is formed.

The details of the mechanical seals 51 and 52 are shown in FIGS. 4 and 5. The lubrication oil introduced from the bottom of the vacuum pump is led to the fixed rings 511 and 521 of the four mechanical seals, flows around the shaft, cools the shaft, lubricates and cools the sealing surface of the fixed rings 511 and 521 and the rotary rings 512 and 522 and the bearings, and falls into the oil vessel from the side of the bearing. The excessive lubrication oil overflows from the upper portion of the mechanical seal through the hole communicating with the oil vessel. The lubrication oil which falls into the oil vessel 271 of the gear side and the oil vessel 272 of the driving side can be circulated by forming the return oil piping 43 to lead to the external oil vessel 40 as a circulation flow path.

In the vacuum pump according to an embodiment of the present invention, the mechanical seal and the bearing are lubricated and cooled, the shaft is cooled satisfactorily, and the bearing is not heated higher than a temperature allowed for the use of the bearing. In the case where the gas in the housing is maintained at a high temperature, since the bearing, the gear, and the like are protected from the high temperature of the housing, it is not necessary to cool the suction gas, it is possible to handle the gas which may be solidified by cooling, and therefore the vacuum pump can be run appropriately.

Figure 7:
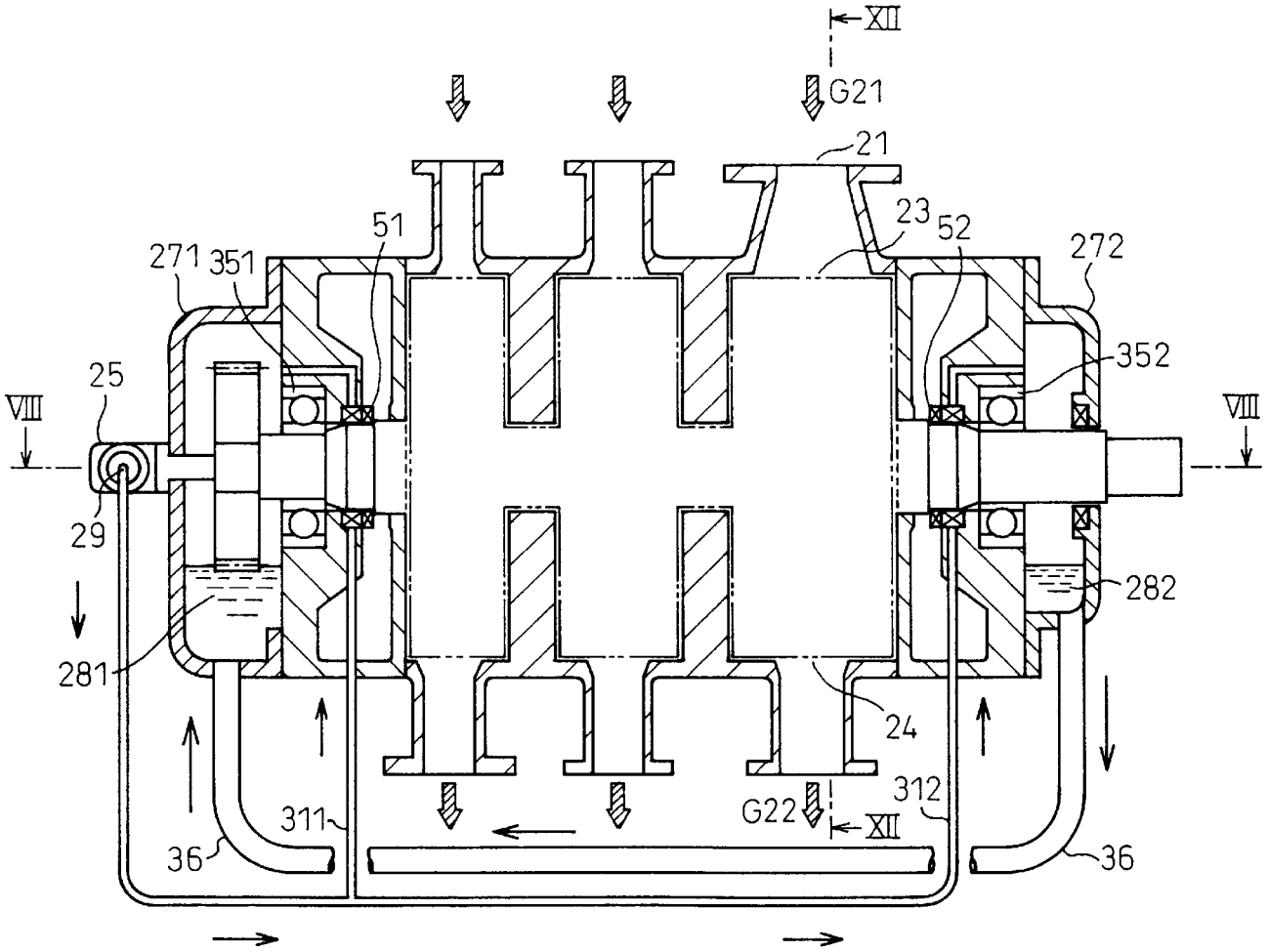
FIG. 7 shows a vacuum pump according to another embodiment of the present invention.
Figure 8:
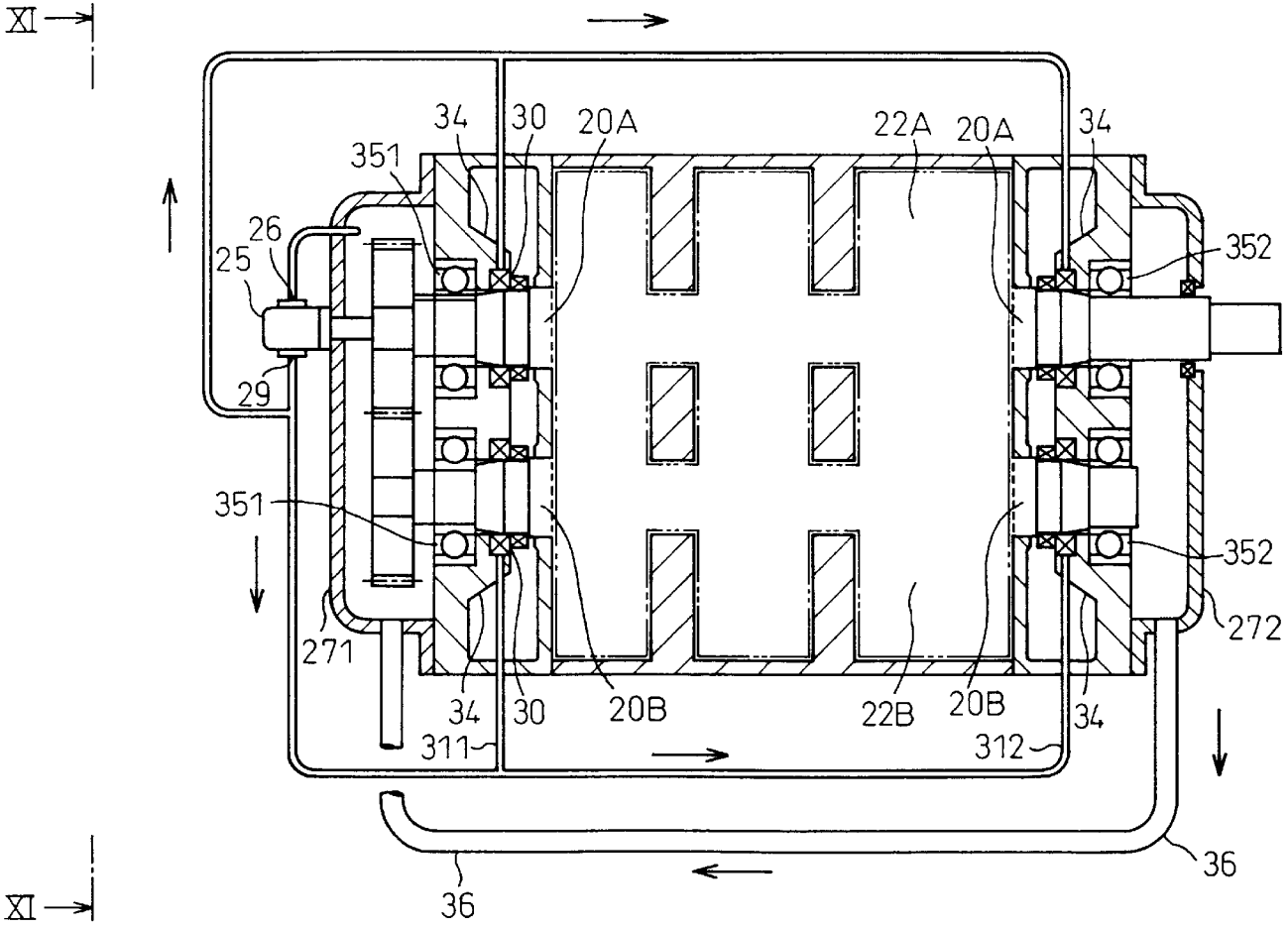
FIG. 8 shows a cross-sectional view of the vacuum pump of FIG. 7 along line VIII—VIII.
Figure 9:
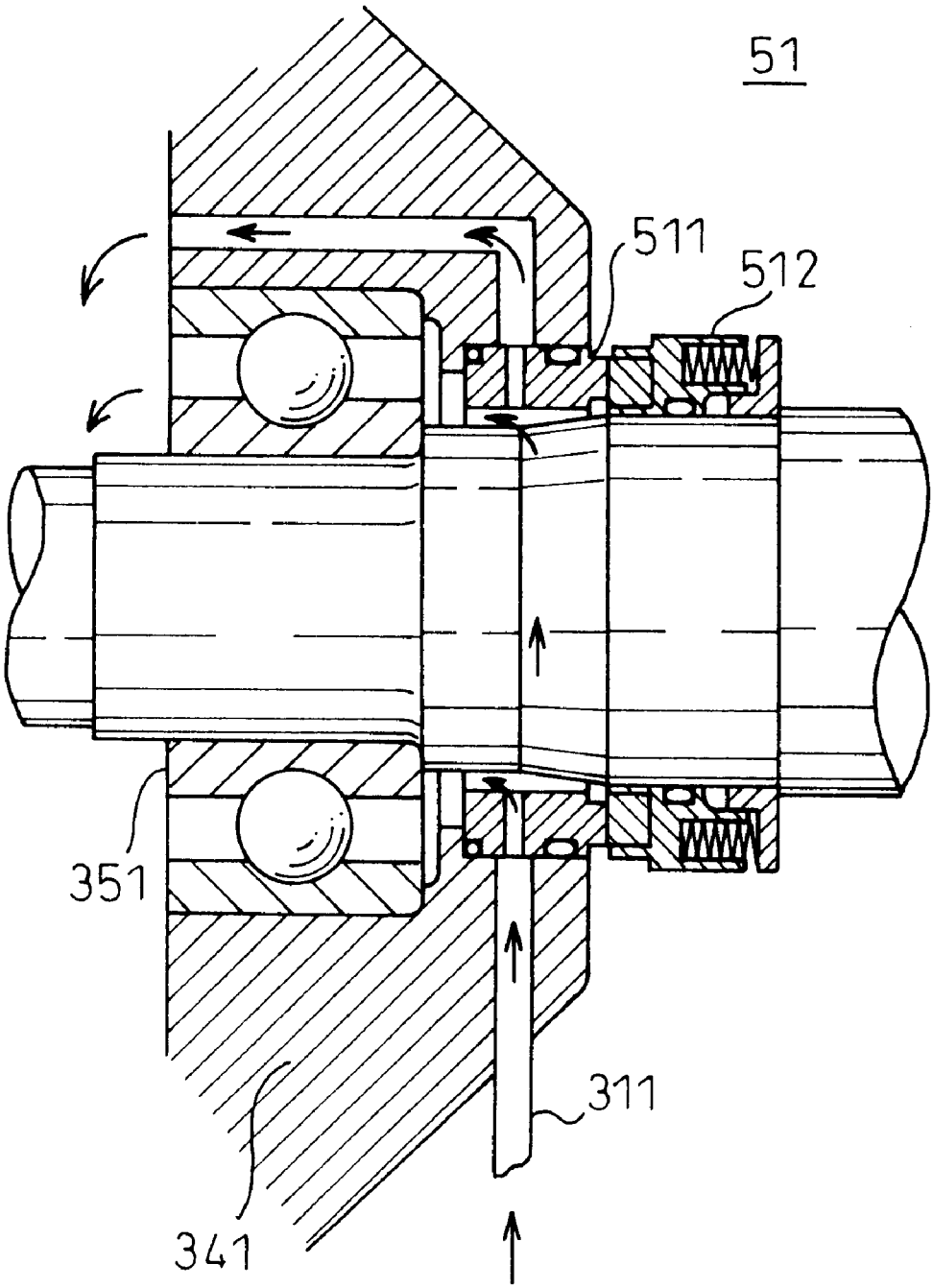
FIG. 9 shows a mechanical seal of left side in the vacuum pump of FIG. 7.
Figure 11:
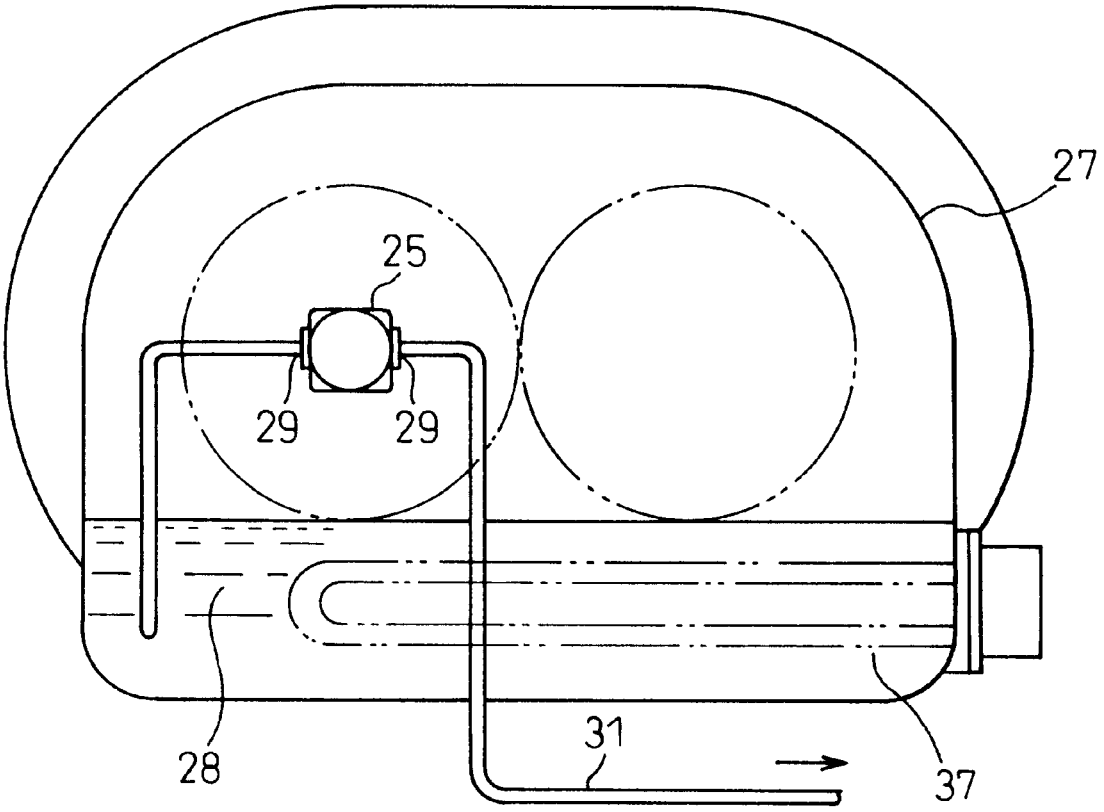
FIG. 11 shows a view in the direction XI—XI of the vacuum pump of FIG. 8.
Figure 12:
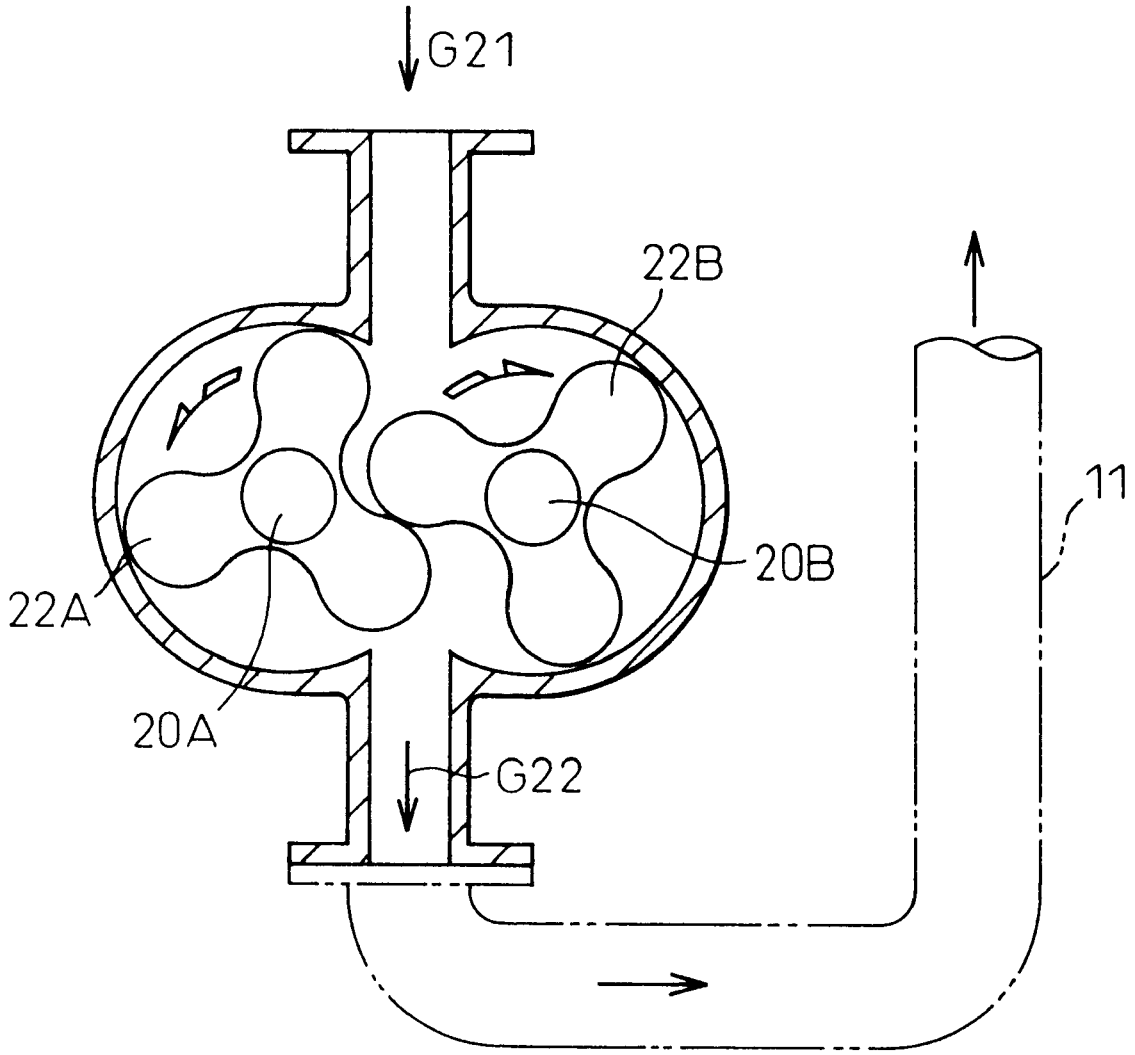
FIG. 12 shows a cross-sectional view of the vacuum pump of FIG. 7 along line XII—XII.
Figure 13:
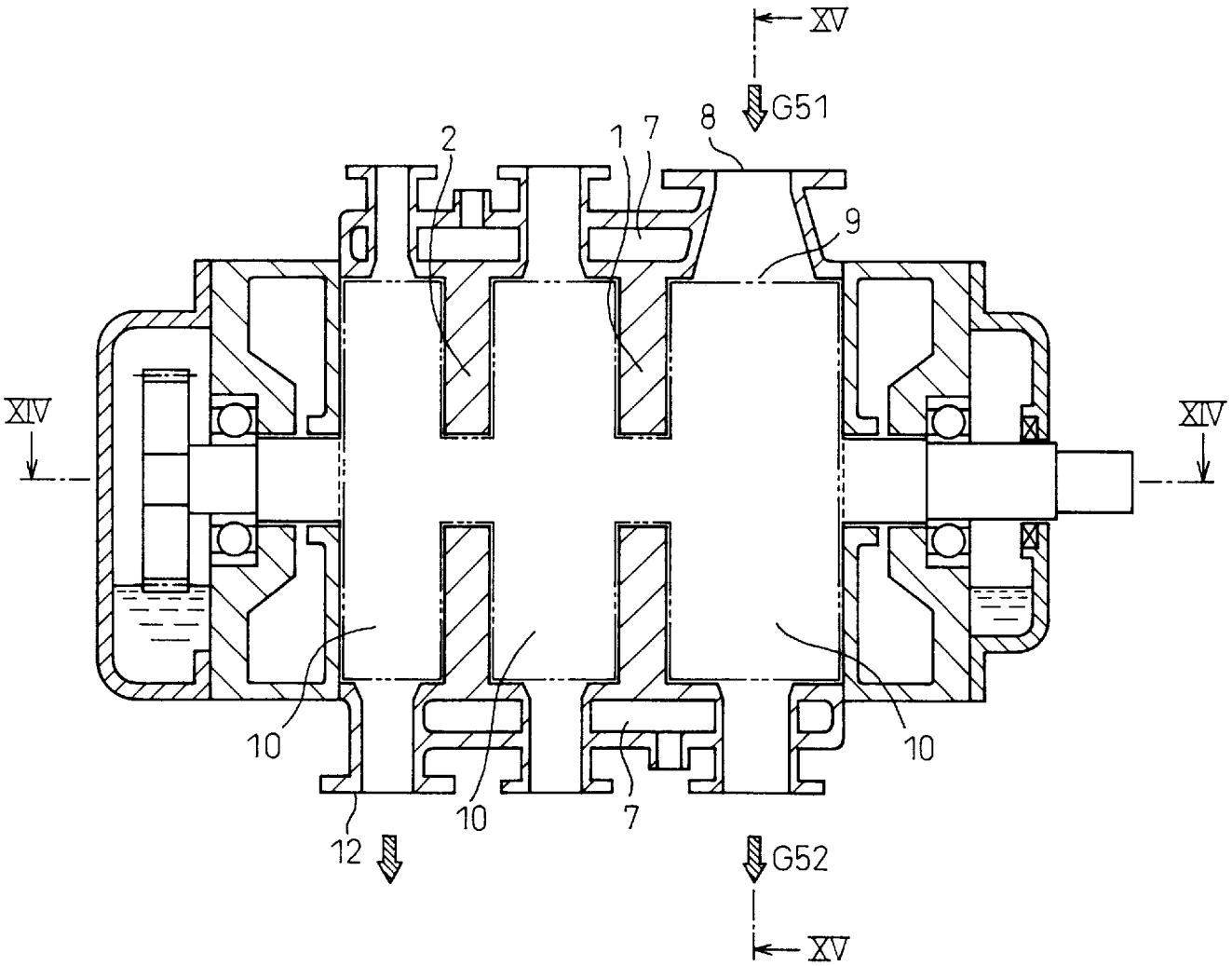
FIGS. 13 to 16 shows a vacuum pump with a first, a second, and a third pump sections as an example of a multi-stage vacuum pump cooled from outside.
Figure 14:
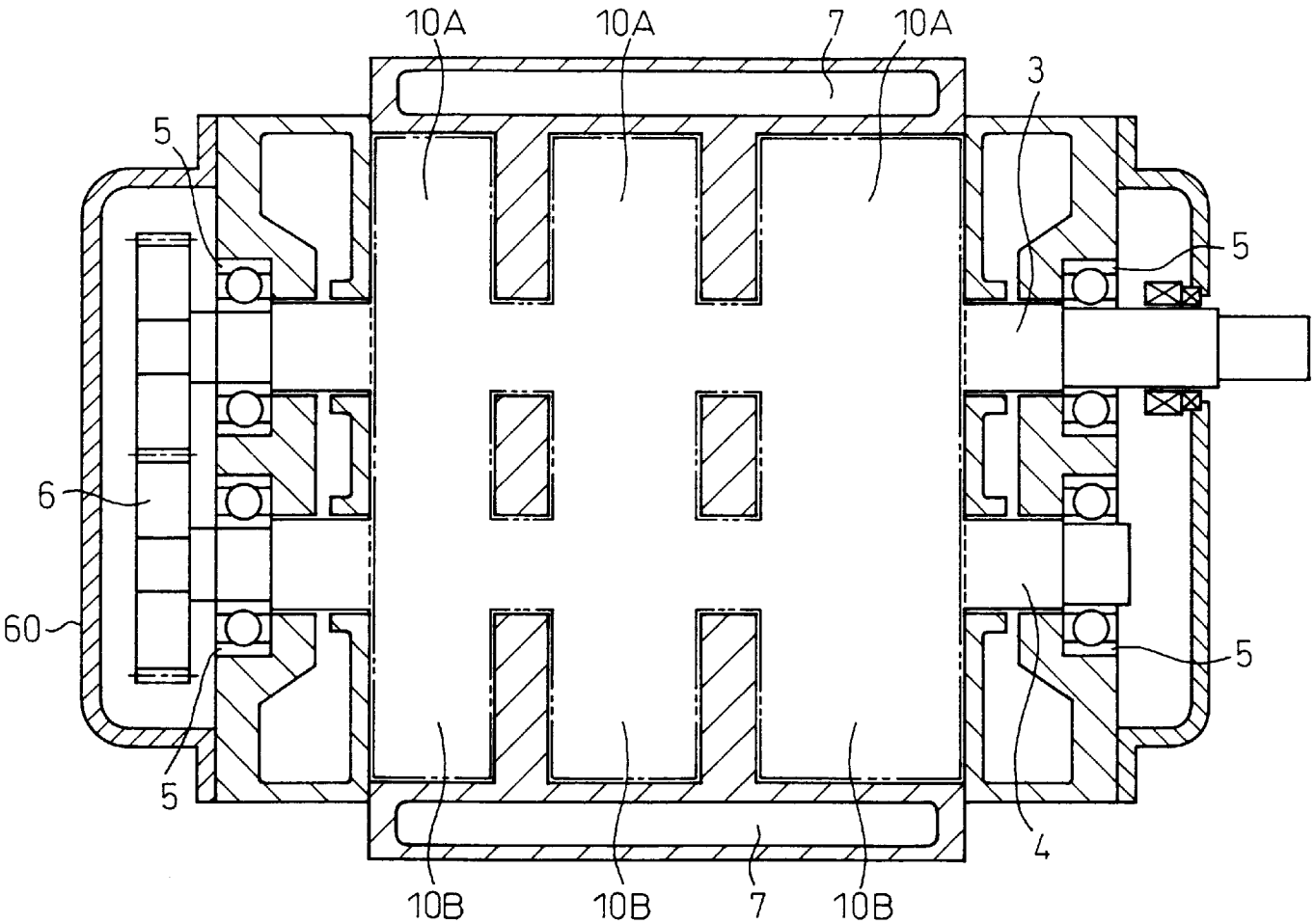
Figure 15:
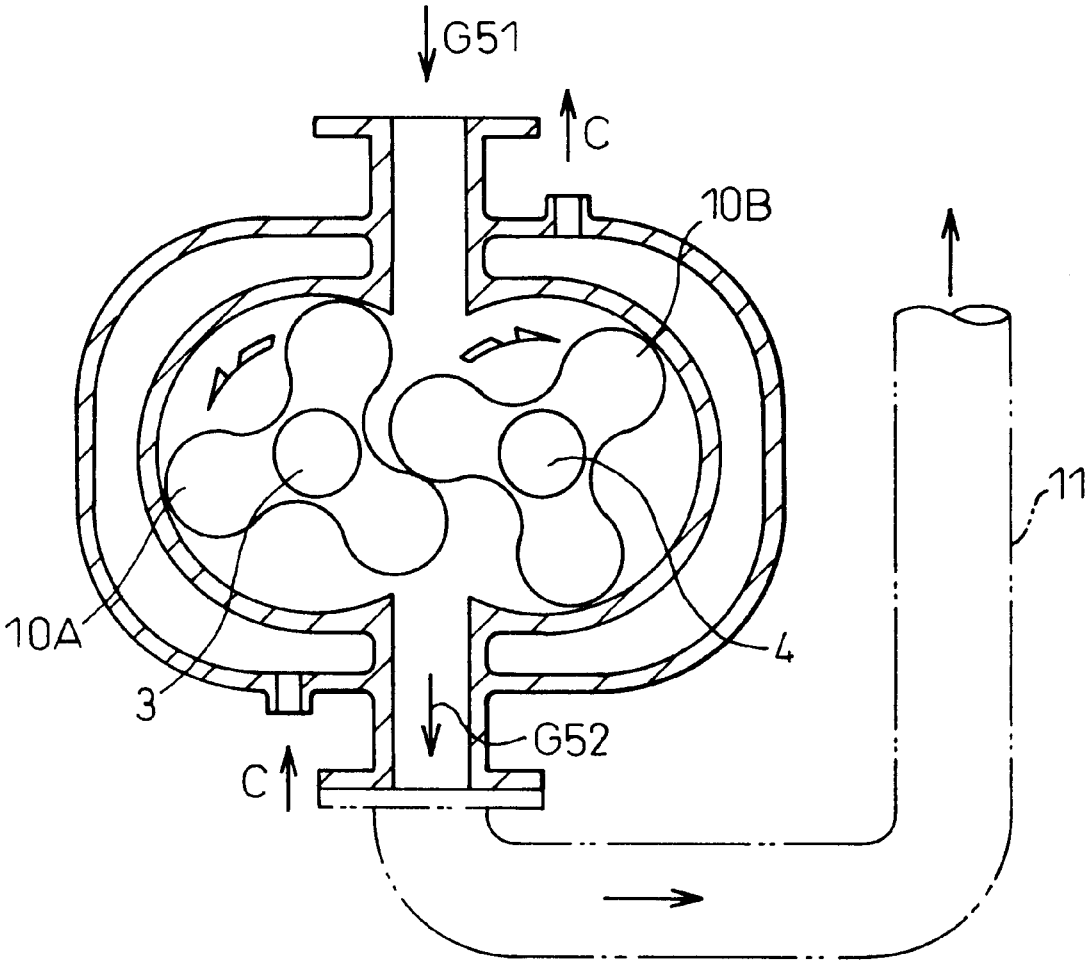
Figure 16:
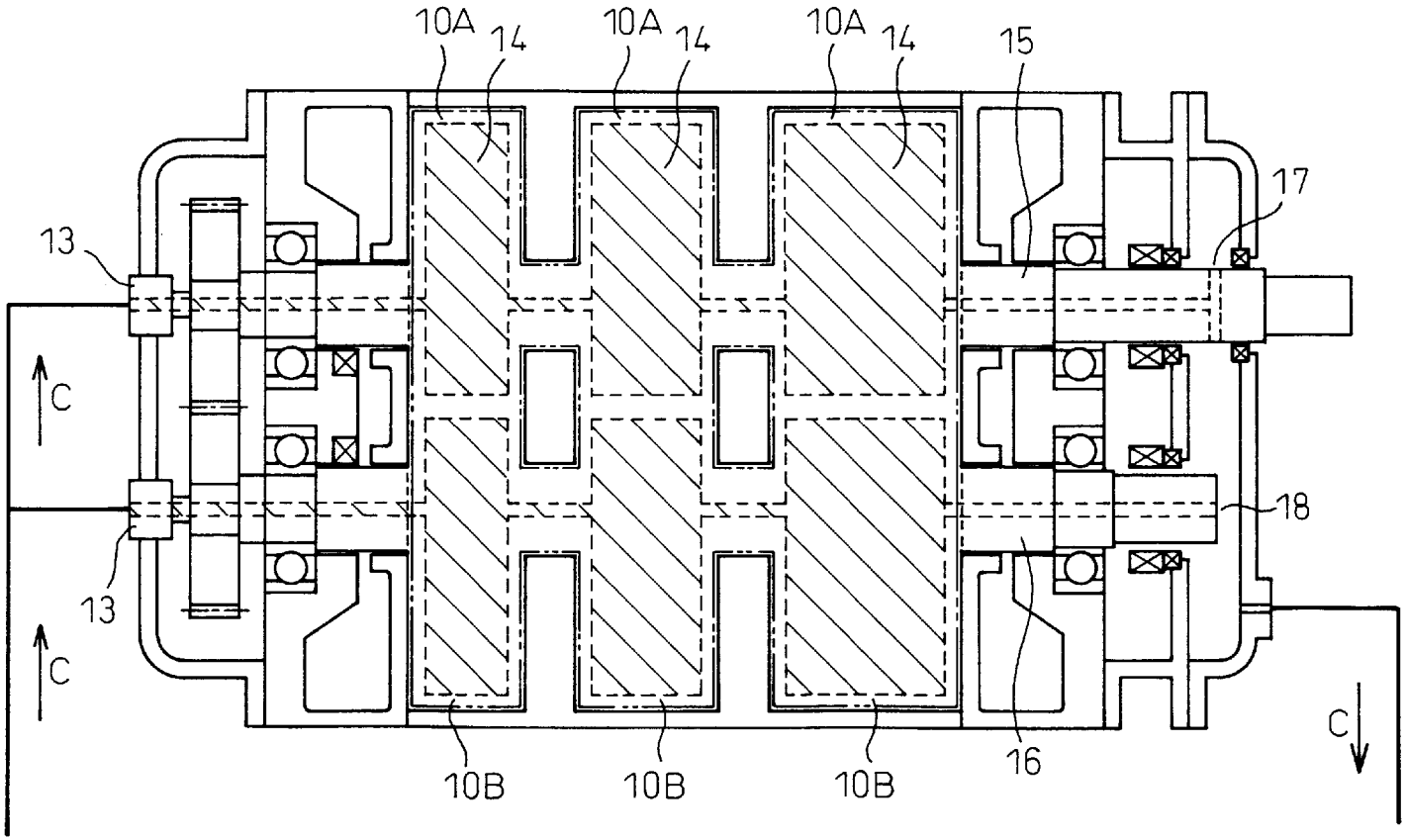

A three stage rotary type vacuum pump according to another embodiment of the present invention will be explained with reference to FIGS. 7 to 12. The VIII—VIII cross-sectional view of the vacuum pump of FIG. 7 is shown in FIG. 8, the left side mechanical seal of the vacuum pump is shown in FIG. 9, and the left side mechanical seal in FIG. 10. The view in the direction XT—XT of the vacuum pump of FIG. 8 is shown in FIG. 11, and the view in the direction XII—XII of the vacuum pump of FIG. 7 is shown in FIG. 12.

The constitution of the vacuum pump shown in FIGS. 7 to 12 is substantially the same as that of the vacuum pump shown in FIGS. 1 to 3.

The oil pump 25 for supplying lubrication oil is arranged at the end of the gear side of the shaft, the suction opening 26 of the oil pump is communicated with the lubrication oil 281 in the oil vessel 271 of the gear side accommodating the gear, and the discharge opening 29 is communicated with the mechanical seal supporting body 34. The lubrication oil is sucked through the suction opening 26 and supplied to the mechanical seal supporting body 34.

Figure 10:
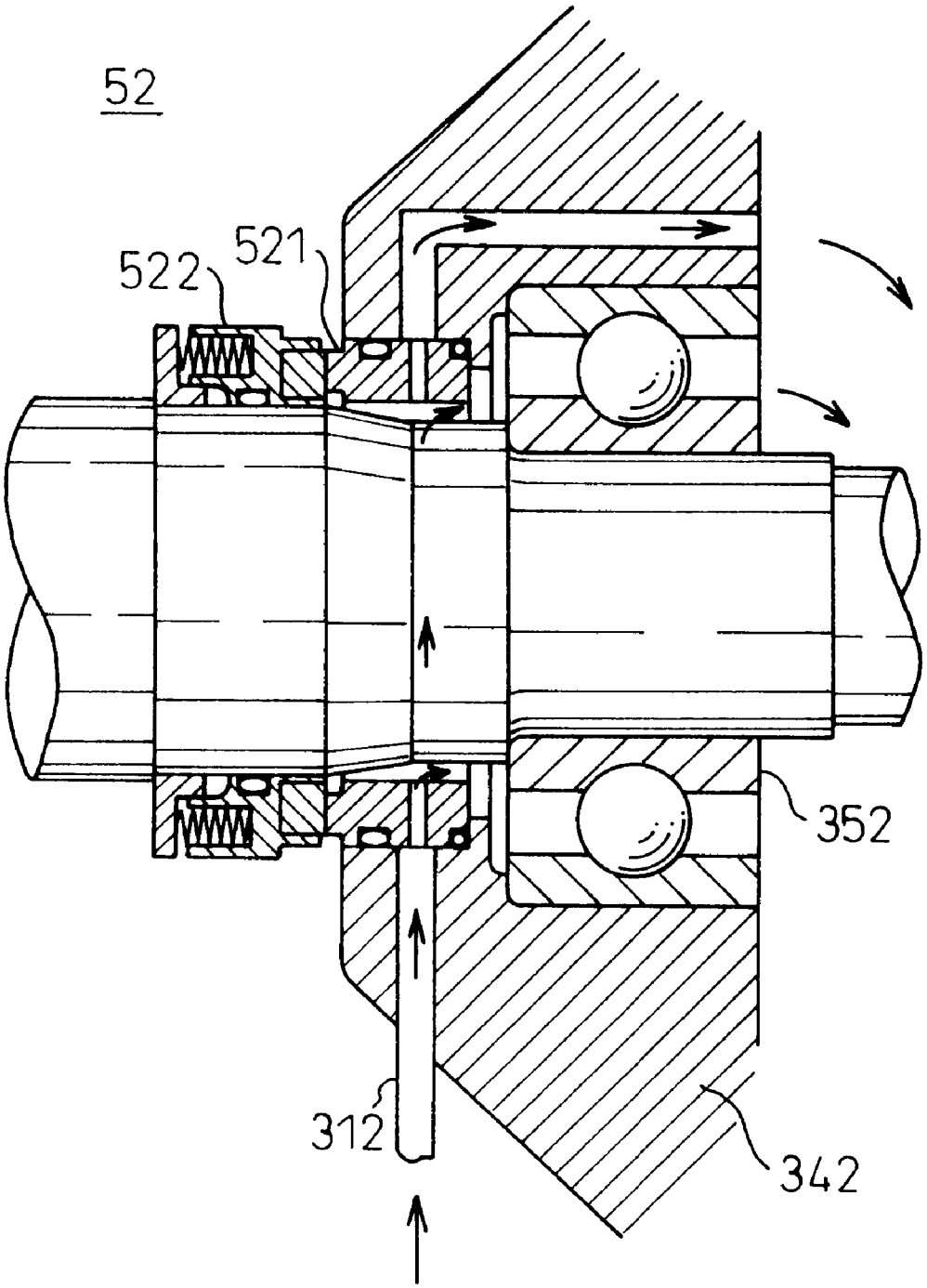
FIG. 10 shows a mechanical seal of right side in the vacuum pump of FIG. 7.

The details of the mechanical seals 51 and 52 are shown in FIGS. 9 and 10. The lubrication oil is sucked from the oil vessel 271 of the gear side which accommodates the gear, and is supplied through the mechanical seal supporting bodies 341 and 342 to the bearings 351 and 352. A part of the lubrication oil flows into the oil vessel 271 of the gear side accommodating the gear, while the remainder of the lubrication oil flows into the oil vessel 272 of the driving side. The lubrication oil 282 returns through the return oil piping 36 to the oil vessel 271 of the gear side, so that the lubrication oil can be circulated.

The cooling device 37 is arranged in the oil vessel 271 as shown in FIG. 11 to cool the oil the temperature of which it has been raised. The oil vessel 27 of the gear side, the lubrication oil 28, and the oil passage 31 are shown in FIG. 11. The lubrication oil lubricates and cools the bearings 351 and 352 supporting the two shafts 20A and 20B and the mechanical seals 51 and 52, and cools the shaft satisfactorily. Therefore, the bearings are prevented from being heated to a temperature which exceeds the use allowable temperature.

The details of the mechanical seals 51 and 52 are shown in FIGS. 9 and 10. The lubrication oil introduced from the bottom of the vacuum pump is led to the fixed rings 511 and 521 of the four mechanical seals, flows around the shaft, cools the shaft, lubricates and cools the sealing surfaces of the fixed rings 511 and 521 and the rotary rings 512 and 522 and the bearings of the mechanical seals, and falls from the bearing side into the oil vessel. The excessive lubrication oil overflows from the upper portion of the mechanical seal through the hole which communicates with the oil vessel.

What is claimed is:

1. A multiple-stage rotary dry type vacuum pump comprising a plurality of pump sections including shafts supported by bearings on both driving and gear sides, a rotor fixed to the shaft, a pair of gears at ends of the shaft for synchronously driving a plurality of the rotors, oil vessels for reserving lubrication oil in the pump sections, and a housing with a suction inlet and an exhaust outlet, the exhaust outlet of one pump section being communicated with the section inlet of the next pump section through a communication path, only vacuum pump handling gas being introduced into operation housings of the pump sections without introducing liquid thereto, a gas compressed in one pump section passing through the communication path into the next pump section to cause the gas to successively be compressed in the plurality of pump sections, wherein mechanical seals are arranged in the sides of said pump housing adjacent to said bearings, an oil pump for lubrication oil for the bearings is arranged for supplying lubrication oil to the bearings, the oil pump is communicated with the oil vessel, the discharge opening of the oil pump is communicated with an oil supply pipe connected to the supporting bodies of the mechanical seals so that lubrication oil passes through the supporting bodies of the mechanical seals, and a return oil piping is arranged for returning the lubrication oil.

2. A multiple stage rotary type vacuum pump according to claim 1, wherein one of said oil vessels for reserving lubrication oil is arranged outside the housing, said oil pump for circulating the lubrication oil being attached to said one oil vessel, said oil pump having a suction opening and a discharge opening, the suction opening of the oil pump being in communication with said oil vessel, the discharge opening of the oil pump being in communication with an oil supply pipe of the oil supply piping system to provide the lubricating oil to the supporting bodies of the mechanical seals.

3. A multiple stage rotary type vacuum pump according to claim 1, wherein the oil pump is arranged at an end of one of the shafts, said oil pump having a suction opening and a discharge opening, said housing having a gear side where gears interconnect said shafts and a driving side where at least one of said shafts is driven, the suction opening of the oil pump being in communication with the lubrication oil in one of the oil vessels which is located on the gear side of the housing, the discharge opening of the oil pump being in communication with an oil supply pipe of the oil supply piping system so as to provide communication with the support bodies of the mechanical seals of the gear side and the driving side, the return oil piping system having a return pipe providing communication between the one oil vessel of the gear side and another oil vessel in the driving side.

* * * * *